US005226484A

United States Patent [19]

Stephen

[11] Patent Number: 5,226,484

[45] Date of Patent: Jul. 13, 1993

[54] EMERGENCY CASING SUPPORT USING STANDARD CASING HANGER

[75] Inventor: Garry R. Stephen, Aberdeen, Scotland

[73] Assignee: ABB Vetco Gray Inc., Houston, Tex.

[21] Appl. No.: 810,467

[22] Filed: Dec. 19, 1991

[51] Int. Cl.[5] ..... E21B 23/00

[52] U.S. Cl. ..... 166/382; 166/208; 166/213; 166/217

[58] Field of Search ..... 166/84, 85, 208, 216, 166/217, 345, 360, 382

[56] References Cited

U.S. PATENT DOCUMENTS

| | | | |
|---|---|---|---|
| 4,077,472 | 3/1978 | Gano | 166/382 |
| 4,154,298 | 5/1979 | Gano | 166/85 |
| 4,595,063 | 6/1986 | Jennings et al. | 166/382 |
| 4,791,987 | 12/1988 | Cassity et al. | 166/217 X |
| 4,832,125 | 5/1989 | Taylor | 166/208 X |
| 4,836,579 | 6/1989 | Wester et al. | 166/84 X |
| 4,848,462 | 7/1989 | Allwin | 166/208 |
| 4,911,244 | 3/1990 | Hynes | 166/360 X |
| 4,938,289 | 7/1990 | Van Bilderbeek | 166/352 X |
| 4,949,786 | 8/1990 | Eckert et al. . | |
| 4,979,566 | 12/1990 | Hosie et al. . | |
| 5,031,695 | 7/1991 | Cain et al. | 166/208 X |

*Primary Examiner*—Ramon S. Britts
*Assistant Examiner*—Frank S. Tsay
*Attorney, Agent, or Firm*—James E. Bradley

[57] ABSTRACT

An emergency casing support utilizes a conventional casing hanger. Casing hanger lands on a wellhead housing internal landing shoulder. The emergency support secures to the lower end of the casing hanger. The emergency support has a body which carries a slips bowl. Body also carries a seal for sealing between the casing and the body. A sleeve nut is engaged by a setting tool lowered through the casing hanger into the body. The sleeve nut when rotated causes the bowl to move upward relative to the slips and also energizes the seal.

13 Claims, 2 Drawing Sheets

EMERGENCY CASING SUPPORT USING STANDARD CASING HANGER

BACKGROUND OF THE INVENTION

1. Field of the Invention

This invention relates in general to wellhead equipment for oil and gas wells, and in particular to an emergency casing hanger system.

2. Description of the Prior Art

In a well of the type concerned herein, a wellhead housing will be located at the top of the well. The wellhead housing has a landing shoulder within its bore. When running casing, the casing is lowered into the well. Normally a casing hanger is installed at the upper end of the string of casing. The casing hanger lands on the landing shoulder in the bore of the wellhead housing. After cementing, a seal is positioned between the casing and the wellhead housing. The seal locates between machined surfaces on the wellhead housing and on the casing hanger.

Occasionally, the casing will not smoothly proceed to the bottom of the well. When this occurs, the casing hanger will not be properly positioned to land in the wellhead housing. Generally, when this happens the casing cannot be retrieved to the surface and becomes stuck. Normally, the operator then cements the casing in place and cuts the casing above the landing shoulder. In the prior art technique, the assembly is supported by slips in the wellhead housing. A seal will seal between the casing and the wellhead housing.

A disadvantage of this prior art technique is that the seal must seal against the exterior of casing, which will not have a smooth machined surface. The casing outer diameter has a high dimensional variation. The outer diameter may be slightly oval shaped. The surface of the casing may have many defects, such as rust, pock marks, and tong marks.

SUMMARY OF THE INVENTION

In this invention, a conventional casing hanger is employed, rather than utilizing slips and a seal between the casing and the wellhead housing. After cementing, the casing will be cut off below the internal landing shoulder in the wellhead housing. A conventional casing hanger will be assembled with an emergency apparatus that bridges the gap between the upper edge of the cut casing and the lower end of the casing hanger.

The emergency apparatus includes a body which encircles the casing and is supported to the casing hanger. The body carries a slips bowl which has a set of slips. The body also carries a seal which locates between the casing and the body. A setting means will set the slips and set the seal. The setting mean is actuated by a setting tool lowered into the body. The setting tool moves the bowl upward relative to the slips and pushes downward on the seal to cause the setting action. A conventional seal will then be set between the casing hanger and the wellhead housing in the conventional position.

DETAILED DESCRIPTION OF THE INVENTION

Figure 1A:
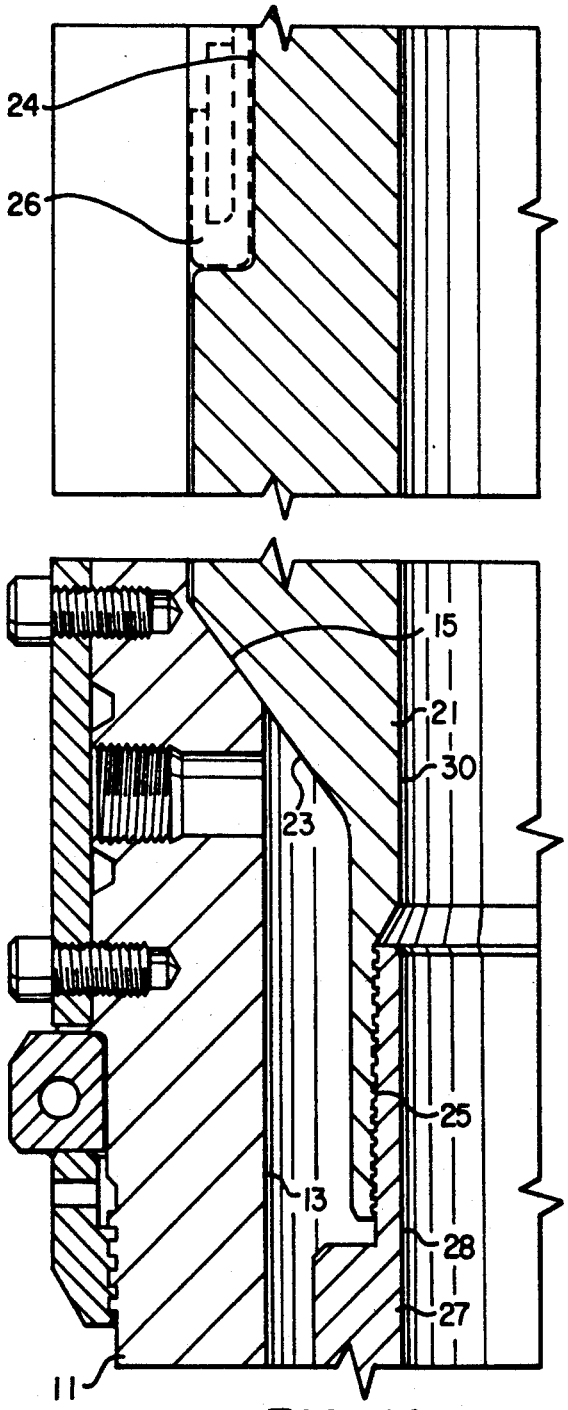
FIGS. 1A and 1B are a vertical sectional view of an emergency casing support constructed in accordance with this invention, and shown prior to setting.

Referring to FIG. wellhead housing 11 is a large tubular member located at the upper end of the well. Wellhead housing 11 has an axial bore 13. Wellhead housing 11 has an internal landing shoulder 15 that faces upward and is conical.

A string of casing 17 (FIG. 1B) will extend into the well and be cemented in place. In the embodiment shown, casing 17 has become stuck in that prior to reaching the total depth of the well, it could not be moved upward or downward. The operator in that situation will then cement the casing 17 in place. In this invention, the operator then cuts off the casing 17 below the wellhead housing landing shoulder 15 resulting in an upper edge 19.

A casing hanger 21 of conventional design will be employed in supporting casing 17. Casing hanger 21 has an external downward facing landing shoulder 23 that is conical for landing on the wellhead housing internal landing shoulder 15. Casing hanger 21 has a machined seal surface 24 above landing shoulder 23 that is cylindrical and spaced inward from the bore 13 of wellhead housing. After casing hanger 21 has been installed, a conventional seal member 26 will be set between the bore 13 and seal surface 24.

Casing hanger 21 also has external flowby slots (not shown) which normally would allow cement returns between casing hanger 21 and bore 13 if installed other than in an emergency event. For the emergency installation herein, the flowby slots will not be utilized during cementing, because the casing hanger 21 will be installed after casing 17 has been cemented. Casing hanger 21 has threads 25 on its lower end. If the casing 17 had not stuck, the casing 17 would be secured to threads 25.

An emergency apparatus including a body upper section 27 secures to threads 25. Body upper section 27 is tubular, having a bore 28 that is of the same diameter as bore 30 of casing hanger 21. This diameter will be the same as the inner diameter of casing 17. Body upper section 27 has external threads 29 located on its lower end.

A body central section 31 secures to threads 29 to rigidly secure body central section 31 and body upper section 27 to casing hanger 21. Body central section 31 has a plurality of elongated apertures or slots 33 that extend upward through the upper end of body central section 31. Slots 33 are spaced circumferentially around body central section 31 and have open upper ends.

A body lower section 35 is integrally formed with body central section 31. Body lower section 35 has a lower portion that encircles casing 17. Body lower section 35 is a solid tubular member. The slots 33 begin at the junction of body lower section 35 with body central section 31, the junction being an upward facing shoulder 36. Body lower section 35 has an internal seat 37 that is an upward facing shoulder. An elastomeric seal 39 is carried on seat 37. Seal 39 is positioned to engage the exterior of casing 17.

Body lower section 35 carries an energizing ring 41 which is part of the seal assembly with seal 39 and energizes or deforms seal 39. Energizing ring 41 is keyed to body lower section 35 to prevent rotation relative to body lower section 35. Energizing ring 41 has a lower end that locates between body lower section 35 and casing 17 in contact with seal 39. Energizing 41 will move axially relative to body lower section 35.

Figure 2:
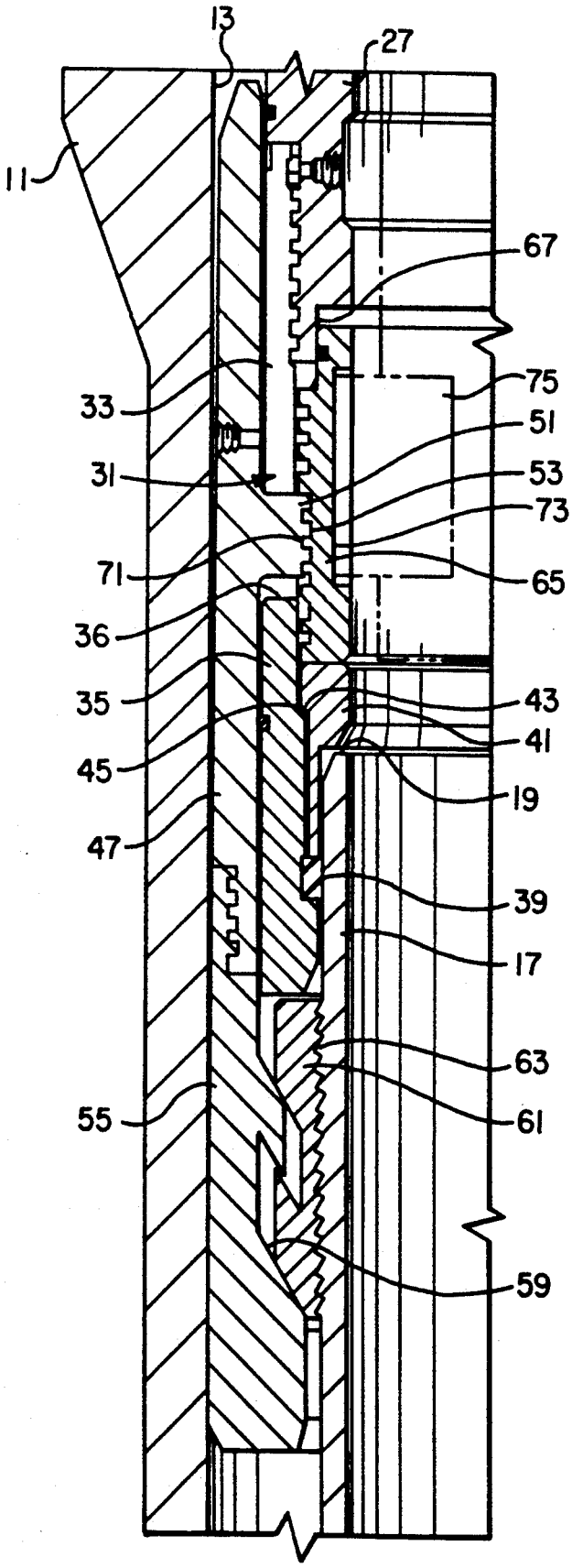
FIG. 2 is a sectional view, similar to FIG. 1B, but showing the emergency casing support in a set position.

Energizing ring 41 has a downward facing stop shoulder 43 on its exterior that is initially spaced above an upward facing stop shoulder 45 formed in the interior of body lower section 35. Initially, there will be a clearance between stop shoulders 43, 45. This clearance closes when energizing ring 41 has moved down far enough to adequately energize seal 39. FIG. 2 shows the stop shoulders 43, 45 in contact with each other.

A bowl sleeve 47 mounts to the exterior of the body sections 27, 31 and 35. Bowl sleeve 47 will move axially with respect to the body sections 27, 31, 35, but is not capable of rotation relative to the body sections 27, 31, 35. Bowl sleeve 47 has an upper end that is sealed by seal 49 to the exterior of body upper section 27. Bowl sleeve 47 has a plurality of fingers 51 protruding radially inward. Each finger 51 fits within one of the slots 33. Bowl sleeve 47 is assembled by inserting the fingers 51 into the open upper ends of the slots 33 before central body section 35 is secured to threads 29.

Figure 1B:
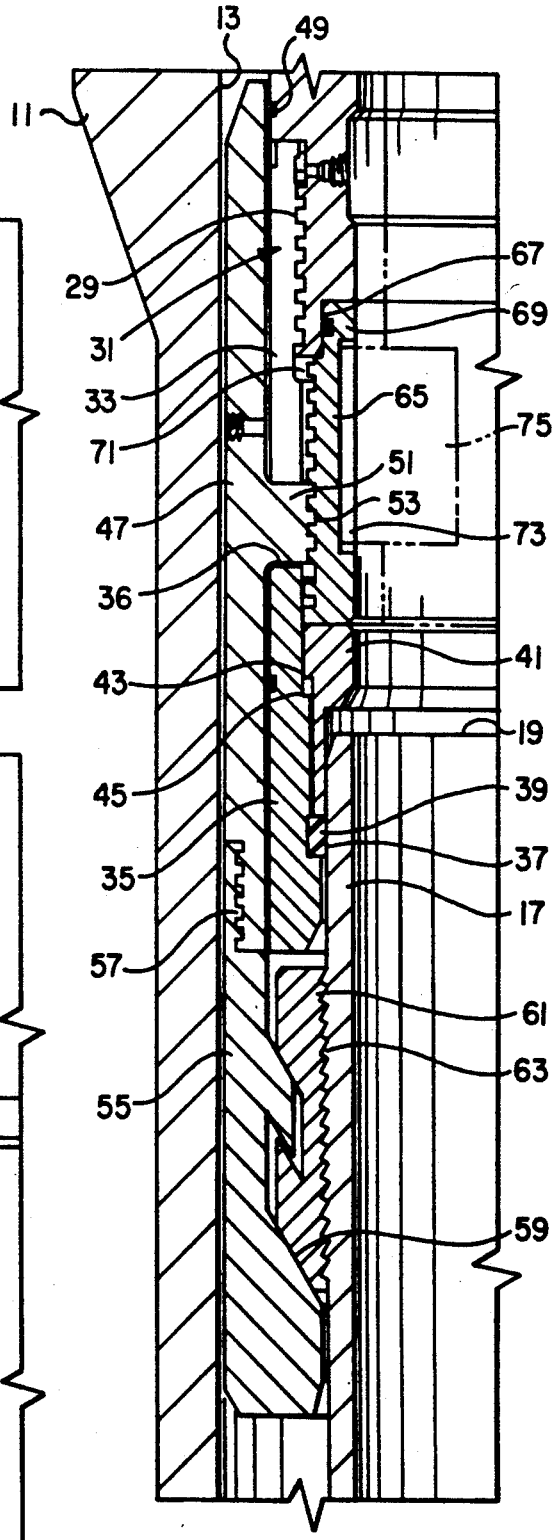

When bowl sleeve 47 is a lower position, shown in FIG. 1B, each finger 51 rests on shoulder 36 of body lower section 35. The axial length of each finger 51 is less than half the distance from shoulder 36 to the lowermost thread 29. This allows the bowl sleeve 47 to move axially in the space between shoulder 36 and the lower end of body upper section 27. FIG. 2 shows bowl sleeve 47 moved upward from the lower position of FIG. 1B. Fingers 51 have a set of bowl sleeve threads 53 formed on their inner faces.

A bowl 55 secures to the lower end of bowl sleeve 47. Bowl 55 secures by threads 57 so as to move axially in unison with bowl sleeve 47. Bowl 55 has conical bowl surfaces 59 on its interior. A plurality of slips 61 locate on the conical surfaces 59. Slips 61 will slide between a retracted position shown in FIG. 1B to an inward gripping position shown in FIG. 2. Slips 61 have teeth 63 which will bite into the exterior of casing 17 while in the gripping position.

A setting means for energizing slips 61 and seal 39 includes a sleeve nut 65. Sleeve nut 65 is carried in the interior of body central section 31. Sleeve nut 65 will rotate and also move axially to some extent relative to body sections 27, 31 and 35. The upper end of sleeve nut 65 locates within a counterbore 67 in the lower end of body upper section 27. A seal 69 seals between the upper end of sleeve nut 65 and counterbore 67.

Sleeve nut 65 has a set of external threads 71 that engage threads 53 on fingers 51. Sleeve nut threads 71 do not engage any portion of body central section 31. A key slot 73 is formed in the interior of sleeve nut 65. A setting tool 75 is adapted to be lowered from above into engagement with key slot 73. Setting tool 75 may be of various types, and will have a key for engaging key slot 73. One suitable type is shown in U.S. Pat. No. 4,979,566, Stanley Hosie, et al., issued Dec. 25, 1990.

In operation, if casing 17 becomes stuck, the operator will cement the casing 17 at that point. During cementing, the casing 17 will extend upward through the wellhead housing 11. Cement returns will flow through the annulus between casing 17 and the conductor pipe (not shown) connected to the lower end of wellhead housing 11. The cement returns pass between casing 17 and wellhead housing 11.

After cementing, the operator will cut off casing 17 below wellhead housing internal landing shoulder 15. This will result in an upper edge 19 a selected distance below internal shoulder 15. The operator assembles the emergency support and secures the upper end of upper body section 27 to casing hanger threads 25. The operator then lowers the casing hanger 21 into wellhead housing bore 13 until external landing shoulder 23 lands on internal landing shoulder 15. The slips 61 will slide around the casing 17 and locate in the surrounding annular space as shown in FIG. 1B.

The operator then lowers setting tool 75 through wellhead housing 11 and through casing hanger 21. Once setting tool 75 engages key slot 73, the operator will rotate setting tool 75. Initially, the sleeve nut 65 will move downward relative to bowl sleeve 47 and body sections 27, 31 and 35. The contact of the teeth 63 of slips 61 provides sufficient frictional resistance to initially prevent bowl sleeve 47 from moving upward relative to body sections 27, 31 and 35 due to rotation of sleeve nut 65.

As sleeve nut 65 moves downward, it will rotate relative to the energizing ring 41 and push the energizing ring 41 downward. Downward movement of energizing ring 41 deforms seal 39. Eventually, stop shoulders 43, 45 will contact each other to prevent any further downward movement of sleeve nut 65. At this point, a portion of the upper end of sleeve nut 65 will still sealingly engage the counterbore 67.

Continued rotation then causes bowl sleeve 47 to start moving upward because of threads 53, 71. The fingers 51 will move upward in the slots 33. Bowl 55 will move upward. The conical surfaces 59 will cause the teeth 63 to bite into the casing 17, as shown in FIG. 2. When sufficient torque has been reached, the operator then will retrieve setting tool 75. The operator then will position and set seal 26 as shown in FIG. 1A to seal the annulus surrounding casing 17.

The emergency support system has significant advantages. The support system allows one to utilize a conventional casing hanger. This provides the operator with smooth sealing surfaces for receiving a conventional seal. No seal is required between the casing and the wellhead housing.

While the invention has been shown in only one of its forms, it should be apparent to those skilled in the art that it is not so limited, but is susceptible to various changes without departing from the scope of the invention.

I claim:

1. In a wellhead assembly of the type having a wellhead housing having an axial bore and an upward facing internal landing shoulder, an improved emergency apparatus for supporting a stuck string of casing, comprising in combination:

a casing hanger having an external landing shoulder adapted to land on the internal landing shoulder of the wellhead housing and having a substantially cylindrical external seal surface located above the external landing shoulder;

a body adapted to encircle the casing and supported to the casing hanger;

a slips bowl carried by the body;

a set of slips carried on the bowl for movement relative to the bowl between an outer position and an inner position in gripping engagement with the casing;

a seal carried by the body in the interior of the body for sealing between the casing and the body;

setting means actuable by a setting tool lowered into the body for moving the bowl upward relative to the slips to cause the slips to move to the inner position, and for energizing the seal; and an annulus seal member installed between the seal surface of the casing hanger and the wellhead housing bore.

2. The emergency apparatus according to claim 1, wherein the bowl is secured to a bowl sleeve carried by the body on the exterior of the body and wherein the setting means moves the bowl sleeve upward relative to the body.

3. The emergency apparatus according to claim 1 wherein the bowl is secured to a bowl sleeve carried by the body on the exterior of the body and wherein the setting means comprises:

a sleeve nut having a set of nut threads and having an internal slot for receiving the setting tool to rotate the sleeve nut;

supporting means for supporting the sleeve nut with the body for allowing rotation of the sleeve nut relative to the body; and a set of bowl sleeve threads on the bowl sleeve and engaged by the nut threads, the engagement of the bowl sleeve threads with the nut threads causing the bowl sleeve to move upward relative to the slips and body to set the slips when the sleeve nut is rotated.

4. The emergency apparatus according to claim 1 wherein the bowl is secured to a bowl sleeve carried by the body on the exterior of the body and wherein the setting means comprises:

a sleeve nut having a set of external nut threads, the sleeve nut being carried by the body for rotation of the sleeve nut relative to the body;

a set of bowl sleeve threads on the interior of the bowl sleeve and engaged by the nut threads;

an internal seat in the body, the seal being carried on the seat;

an energizing ring carried above the seat, having a lower end in engagement with the seal and an upper end engaged by a lower end of the sleeve nut; and the sleeve nut having an internal slot for receiving the setting tool to rotate the sleeve nut, causing the sleeve nut to move downward relative to the bowl sleeve to energize the seal and causing the bowl sleeve to move upward relative to the slips and the body to set the slips.

5. The emergency apparatus according to claim 1 wherein the casing has been cut off such that an upper edge of the casing is spaced below the internal landing shoulder, and wherein the sleeve nut is adapted to locate between a lower end of the casing hanger and the upper edge of the casing.

6. A wellhead assembly comprising in combination:

a wellhead housing having an axial bore and an upward facing internal landing shoulder;

a casing hanger having an external landing shoulder that lands on the landing shoulder of the wellhead housing, and a substantially cylindrical external seal surface located above the external landing shoulder;

a stuck string of casing which has an upper edge located below the casing hanger;

a body having an upper end rigidly secured to the casing hanger below the internal landing shoulder of the wellhead housing and having a lower end extending around the casing below the upper edge of the casing;

a slips bowl carried by the body below the upper edge of the casing for axial movement relative to the body;

a set of slips carried on the bowl for movement relative to the bowl between an outer position and an inner position in gripping engagement with the casing;

a seal carried by the body for sealing against the casing;

a sleeve nut rotatably carried by the body above the upper edge of the casing, the sleeve nut having an internal slot for receiving a setting tool lowered through the casing hanger to rotate the sleeve nut;

energizing means actuated by rotation of the sleeve nut with the setting tool for moving the bowl upward relative to the slips to cause the slips to move to the inner position, and for deforming the seal against the casing; and an annulus seal member installed between the seal surface of the casing hanger and the wellhead housing bore.

7. The wellhead assembly according to claim 6 wherein the energizing means comprises:

a set of nut threads formed on the exterior of the sleeve nut;

a bowl sleeve carried by the body for axial movement relative to the body, the bowl being connected to the bowl sleeve for movement therewith; and a set of internal bowl sleeve threads on the interior of the bowl sleeve in engagement with the nut threads, whereby rotation of the sleeve nut causes upward movement of the bowl sleeve relative to the sleeve nut.

8. The wellhead assembly according to claim 6 wherein the sleeve nut is carried by the body for axial movement as well as rotational movement relative to the body, and wherein the energizing means comprises:

a set of nut threads formed on the exterior of the sleeve nut;

a bowl sleeve carried by the body for axial movement relative to the body, the bowl being connected to the bowl sleeve for movement therewith;

a set of internal bowl sleeve threads on the interior of the bowl sleeve in engagement with the nut threads;

an internal seat in the body, the seal being carried on the seat; and an energizing ring carried above the seat, having a lower end in engagement with the seal and an upper end engaged by a lower end of the sleeve nut, such that rotation of the sleeve nut causes downward movement of the sleeve nut relative to the seat to cause the energizing ring to deform the seal, and continued rotation of the sleeve nut causes upward movement of the bowl sleeve relative to the body to set the slips.

9. In a wellhead assembly of the type having a wellhead housing having an axial bore and an upward facing internal landing shoulder, an improved emergency apparatus for supporting a stuck string of casing which has been cut off to provide an upper edge below the internal landing shoulder, comprising in combination:

a casing hanger having an external landing shoulder adapted to land on the internal landing shoulder of the wellhead housing, the casing hanger having a substantially cylindrical external seal surface located above the external landing shoulder;

a body having an upper end rigidly secured to the lower end of the casing hanger and having a lower end adapted to extend around the casing below the upper edge of the casing, the body having a plurality of elongated axial apertures;

a bowl sleeve carried by the body on the exterior of the body for axial movement relative to the body;

a plurality of inward extending fingers on the bowl sleeve, each extending through one of the apertures of the body and having an inner face;

a set of bowl sleeve threads on the inner faces of the fingers;

a slips bowl connected to the bowl sleeve and adapted to be positioned below the upper edge of the casing;

a set of slips carried on the bowl for movement relative to the bowl between an outer position and an inner position in gripping engagement with the casing;

a seat in the interior of the body below the apertures;

a seal assembly carried on the seat for sealing against the casing;

a sleeve nut carried by the body for rotational and axial movement relative to the body, the sleeve nut adapted to be positioned above the upper edge of the casing, the sleeve nut having a set of external nut threads that engage the bowl sleeve threads, the sleeve nut having an internal slot for receiving a setting tool lowered through the casing hanger, the sleeve nut having a lower end in engagement with the seal assembly, such that rotation of the sleeve nut by the setting tool moves the sleeve nut downward relative to the seat to energize the seal assembly, and continued rotation of the sleeve nut moves the sleeve bowl upward relative to the body and to cause the slips to move to the inner position; and an annulus seal member set between the seal surface of the casing hanger and the bore of the wellhead housing.

10. The emergency apparatus according to claim 9 wherein the seal assembly comprises:

a seal carried on the seat; and an energizing ring carried by the body, having a lower end in contact with the seal and an upper end in contact with the sleeve nut.

11. The emergency apparatus according to claim 9 wherein the seal assembly comprises:

a seal carried on the seat; and an energizing ring carried in the body for axial movement relative to the body, the energizing ring having a lower end in contact with the seal and an upper end in contact with the sleeve nut; and wherein the emergency apparatus further comprises:

a downward facing stop shoulder on the exterior of the energizing ring; and an upward facing stop shoulder in the body for engagement by the energizing ring downward facing stop shoulder after a selected amount of downward movement of the energizing ring relative to the body to limit the amount of deformation applied to the seal.

12. A method of supporting a struck string of casing to a wellhead housing of a type having a bore with an internal landing shoulder, comprising in combination:

cutting off the casing below the internal landing shoulder of the wellhead housing, providing an upper edge;

mounting to a body a slips bowl, a set of slips, a seal, and a setting means for setting the slips and seal;

securing the body to a casing hanger which has an external downward facing landing shoulder and has a substantially cylindrical external seal surface located above the landing shoulder;

landing the landing shoulder of the casing hanger on the internal landing shoulder of the wellhead housing, and inserting the body, slips and seal around the casing, with at least a portion of the setting means located between the upper edge of the casing and a lower end of the casing hanger;

lowering a setting tool through the casing hanger into the body and into engagement with said portion of the setting means;

actuating the setting tool to move the bowl upward relative to the slips to cause the slips to grip the casing and to energize the seal to seal against the casing and setting an annulus seal member between the external seal surface of the casing hanger and the bore of the wellhead housing.

13. The method according to claim 12 the setting tool is actuated by rotation.

* * * * *